US006286597B1

(12) United States Patent
Forsyth et al.

(10) Patent No.: US 6,286,597 B1
(45) **Date of Patent: *Sep. 11, 2001**

(54) SHOE TRACK SAVER AND METHOD OF USE

(75) Inventors: David G. Forsyth; Roddy W. McLeod; Stephen H. Lewis, all of Aberdeen (GB)

(73) Assignee: Baker Hughes Incorporated, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 37 days.

(21) Appl. No.: 09/290,656

(22) Filed: Apr. 12, 1999

(51) Int. Cl.[7] ..... E21B 27/00; E21B 43/00
(52) U.S. Cl. ..... 166/285; 166/177.4
(58) Field of Search ..... 166/285, 286, 166/287, 290, 177.4, 242.1, 242.8, 242.9

(56) References Cited

U.S. PATENT DOCUMENTS

| | | | | |
|---|---|---|---|---|
| 3,860,217 | | 1/1975 | Grout | 366/336 |
| 3,982,590 | | 9/1976 | Harriman . | |
| 4,083,406 | | 4/1978 | Metz | 166/286 |
| 4,595,058 | * | 6/1986 | Nations | 166/285 |
| 4,614,440 | | 9/1986 | King | 366/336 |
| 4,984,633 | | 1/1991 | Langer et al. . | |
| 5,494,107 | * | 2/1996 | Bode | 166/285 |
| 5,507,346 | * | 4/1996 | Gano et al. | 166/285 |
| 5,622,224 | * | 4/1997 | Yates | 166/285 |

FOREIGN PATENT DOCUMENTS 2115860 9/1983 (GB) .

OTHER PUBLICATIONS

SU383825 Bulatov, et al. Abstract.
SU1712587 Ukhta Abstract.

* cited by examiner

*Primary Examiner*—David Bagnell
*Assistant Examiner*—Jennifer R. Dougherty
(74) *Attorney, Agent, or Firm*—Steve Rosenblatt

(57) ABSTRACT

An inline component for a liner assembly, usable particularly in deviated wellbores, is disclosed. The component involves a series of offset passages to create sufficient turbulence in the circulating cement during a cementing job so as to eliminate the phenomenon of roping where there is inefficient displacement of mud with the circulating cement. The multi-component inline device has peripheral seals to prevent leakpaths along the inside wall of the casing being cemented. The offset flow passages are presented in individualized components which are rotationally locked to each other and have peripheral sealing devices. The stack of components is retained within the casing to prevent its longitudinal movement during the pumping of cement. The preferred materials are soft metallics which facilitate drilling out if required. The interlocking nature of the components also eliminates relative rotation to facilitate drill-out.

24 Claims, 5 Drawing Sheets

SHOE TRACK SAVER AND METHOD OF USE

FIELD OF THE INVENTION

The field of this invention relates to devices which ensure a proper cement seal for liner assemblies in highly deviated wellbores.

BACKGROUND OF THE INVENTION

Typical cementing assemblies involve a landing collar above a float collar, which is in turn above a float shoe. The float shoe and float collar have valves in them and generally have fairly small openings for such valves. These components are located at the bottom of a liner string to be cemented with some tubulars mounted further below. The assembly at the bottom of the string, when inserted into a highly deviated wellbore, has encountered some operational problems with the cement seal. The "shoe track" refers to the termination of the wellbore where these components are inserted prior to the pumping of cement. When the shoe track is highly deviated and cement is pumped to displace the drilling mud, formation fluid leakage through the shoe track has been experienced. The shoe track generally consists of approximately 100 ft. of liner below the float shoe, which by design remains full of cement after a wiper plug is pumped down against the landing collar to displace the pumped cement out of the liner being cemented down to the landing collar. With the shoe track highly deviated, cement has a tendency to allow water migration if the cement is prepared at the surface with an excess of water. With the shoe track essentially horizontal or close to it, i.e., greater than about 70° deviation from vertical, migration of water upwardly creates a flow channel through the cement in the shoe track, allowing formation fluids to migrate into the casing or fluid loss into the formation. One of the reasons excess water is used with the cement mixture is that the cement preparations on the surface are frequently made "on the fly" as opposed to carefully measured batch operations. The control system for on-the-fly mixing of cement slurries is not that precise, resulting in periodic blends which have an excess of water.

Another phenomenon that could lead to undermining the cement seal in the shoe track is the phenomenon of shrinkage of the cement. Generally, cement when setting will shrink approximately a half of a percent. Shrinkage, especially in the area of the float shoe or float collar, could result in movement of these valves off their seats to leave them in a slightly open position. Thus, the ability of the float shoe and float collar to act as seals after the cement has set can be adversely affected.

The shrinkage of the cement also presents opportunities in highly deviated wellbores for fluid flow adjacent the inside wall of the casing.

A phenomenon known as "roping" has been suspected as the cause of inefficient displacement of mud with the cement. One suspected cause is the necessity of pumping the cement through the float shoe and float collar which have fairly small bores. The flow pattern of the cement emerging from the float shoe and float collar is such that it leaves pockets of mud trapped which are not displaced by the cement. These pockets of mud then can become the source of future leakage problems through the cement job through the shoe track.

It is thus an objective of the present invention to provide an economical device that can be installed in the liner assembly, particularly for deviated wellbores with an inclination angle of more than about 70° from the vertical so that leakage paths through the cement can be eliminated. The device should be effective against the roping phenomenon as well as provide seals to potential leakpaths adjacent the inside wall of the casing. The device should also be sufficiently soft so that it can be readily drilled out if necessary. Due to the harsh environment, a device which can accomplish these objectives while being static, i.e., with no moving parts, is desirable. These objectives have been addressed in the present invention, a preferred embodiment of which is described in more detail below.

SUMMARY OF THE INVENTION

An inline component for a liner assembly, usable particularly in deviated wellbores, is disclosed. The component involves a series of offset passages to create sufficient turbulence in the circulating cement during a cementing job so as to eliminate the phenomenon of roping where there is inefficient displacement of mud with the circulating cement. The multi-component inline device has peripheral seals to prevent leakpaths along the inside wall of the casing being cemented. The offset flow passages are presented in individualized components which are rotationally locked to each other and have peripheral sealing devices. The stack of components is retained within the casing to prevent its longitudinal movement during the pumping of cement. The preferred materials are soft metallics which facilitate drilling out if required. The interlocking nature of the components also eliminates relative rotation to facilitate drill-out.

DETAILED DESCRIPTION OF THE PREFERRED EMBODIMENT

Figure 1A:
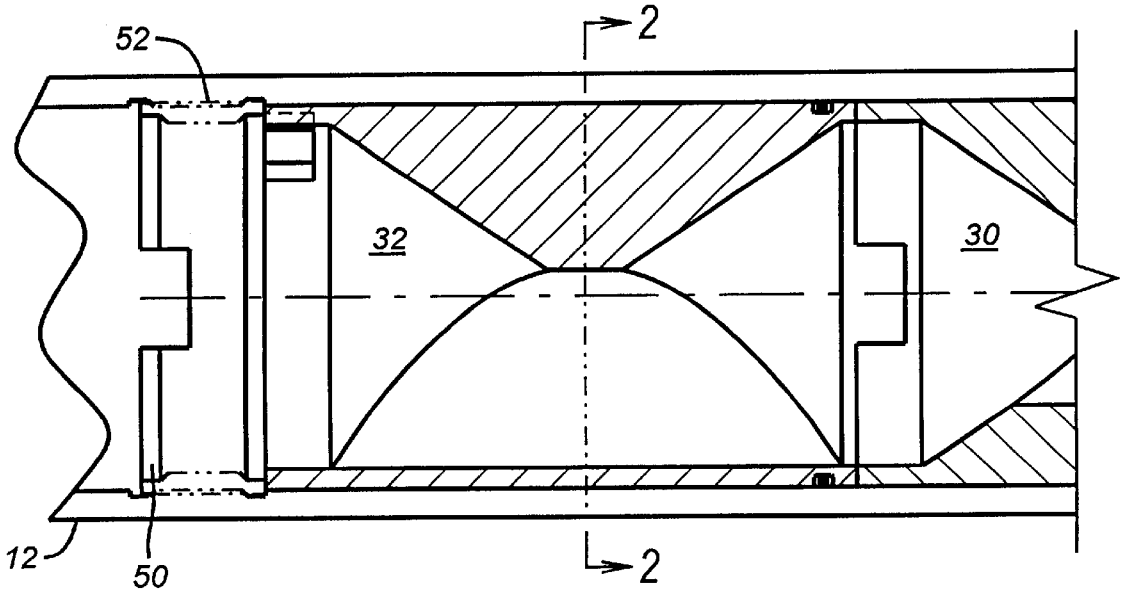
FIGS. 1*a–e* are a cross-sectional elevation of the device in its housing.
Figure 1B:
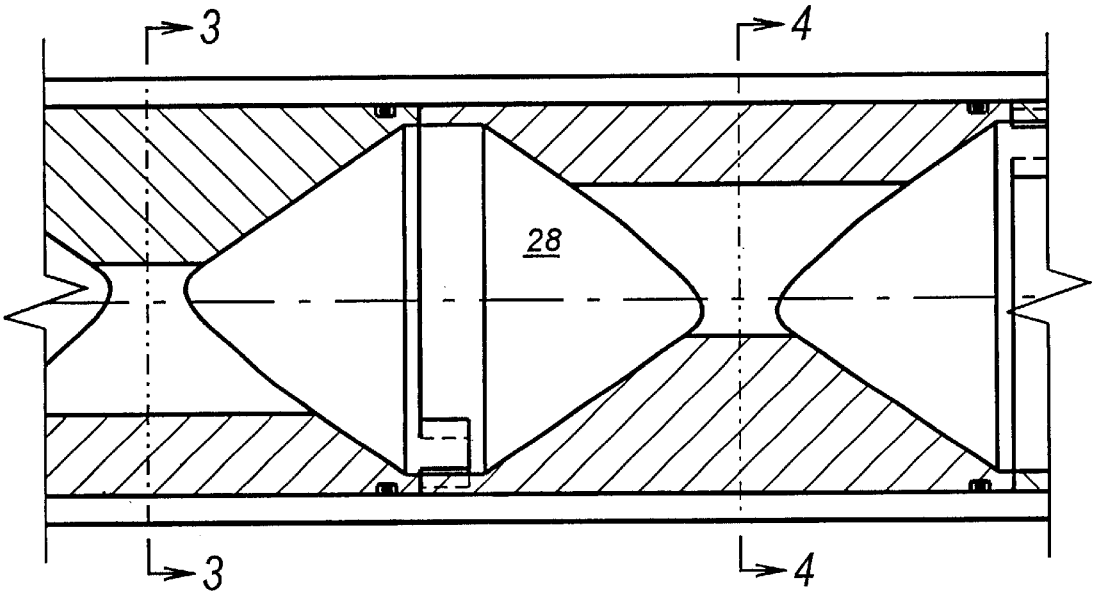
Figure 1C:
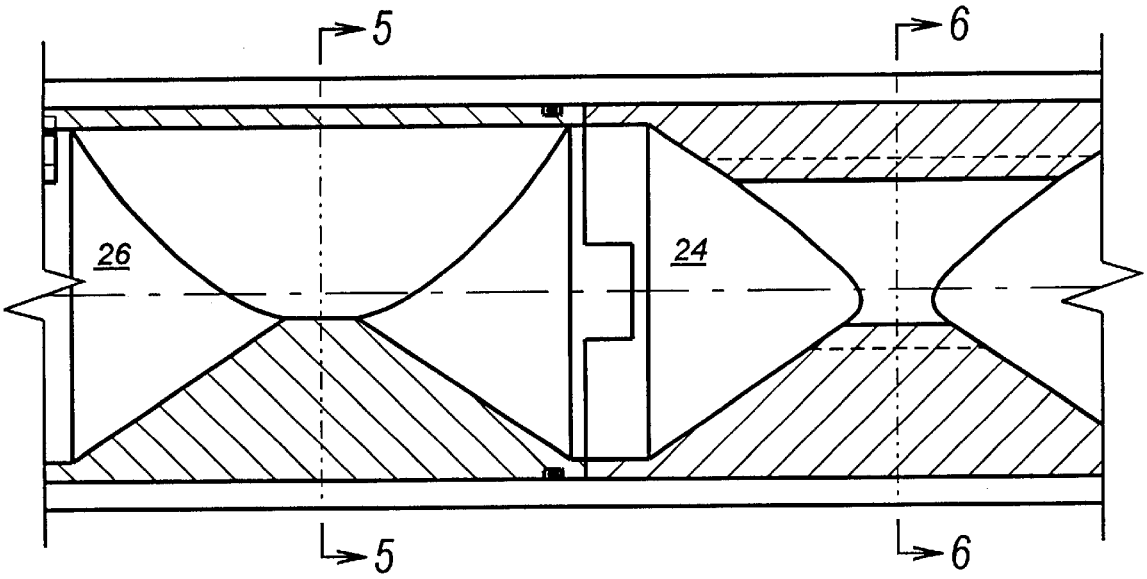
Figure 1D:
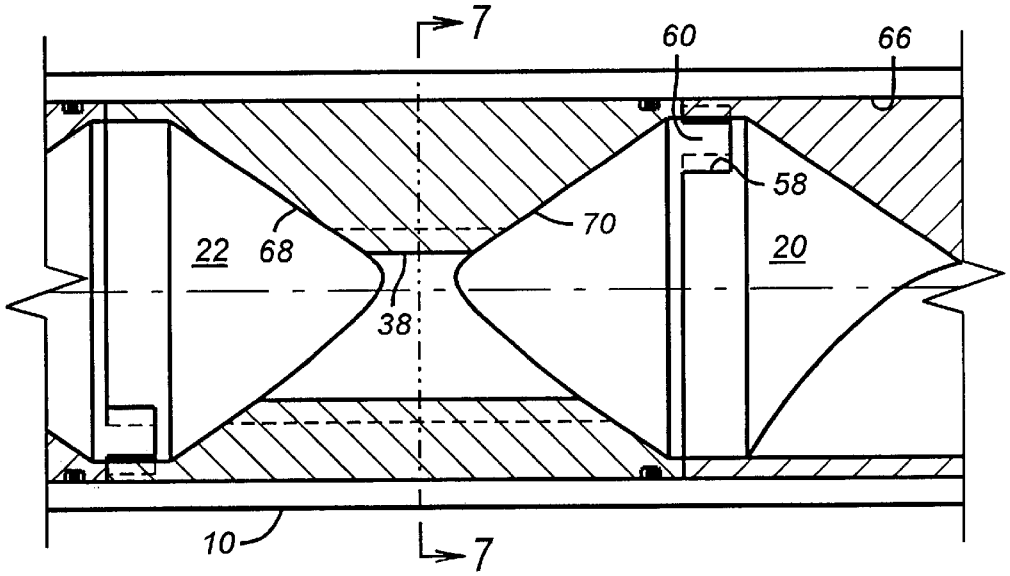
Figure 1E:
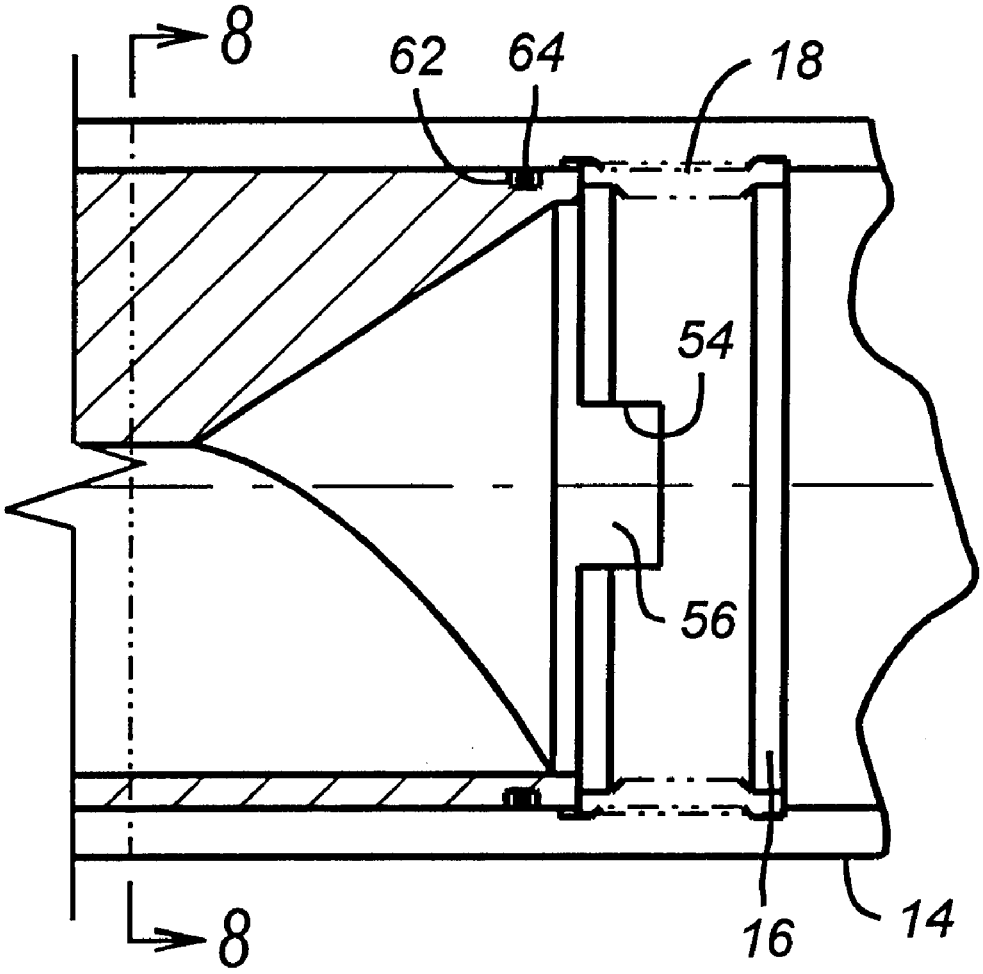
Figure 2:
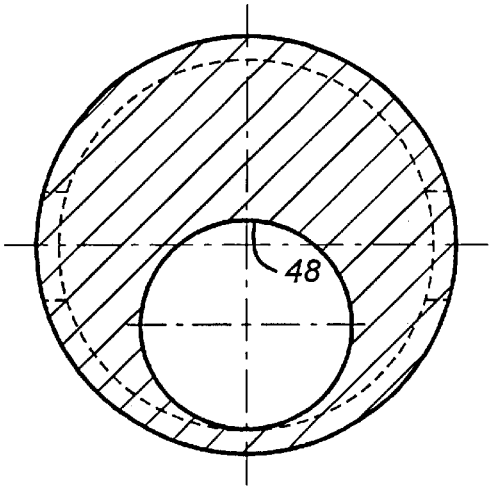
FIG. 2 is a section through lines 2—2 of FIG. 1*a*.
Figure 3:
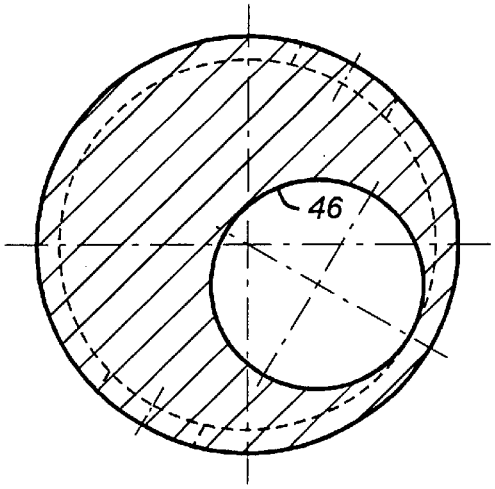
FIG. 3 is a section view through lines 3—3 of FIG. 1*b*.
Figure 6:
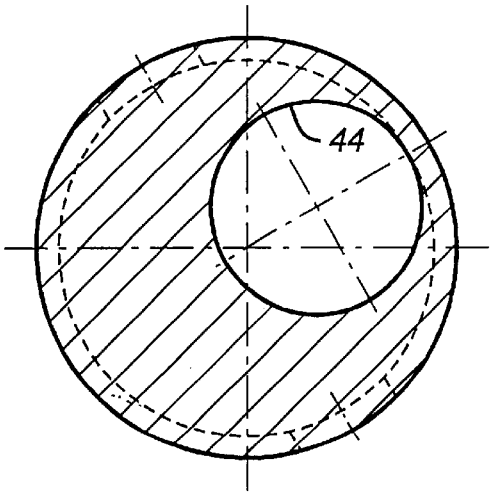
FIG. 6 is a section view along lines 6—6 of FIGS. 1*c*.
Figure 4:
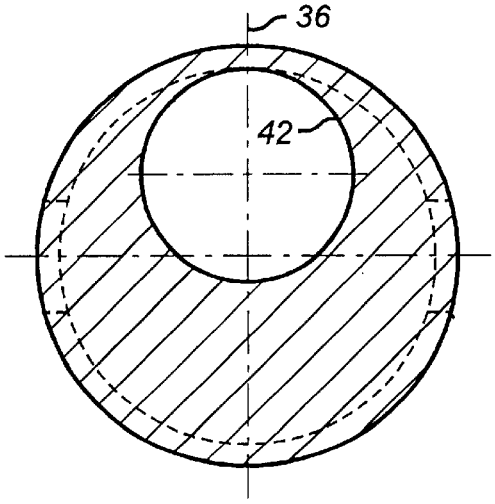
FIG. 4 is a section view along lines 4—4 of FIG. 1*b*.
Figure 5:
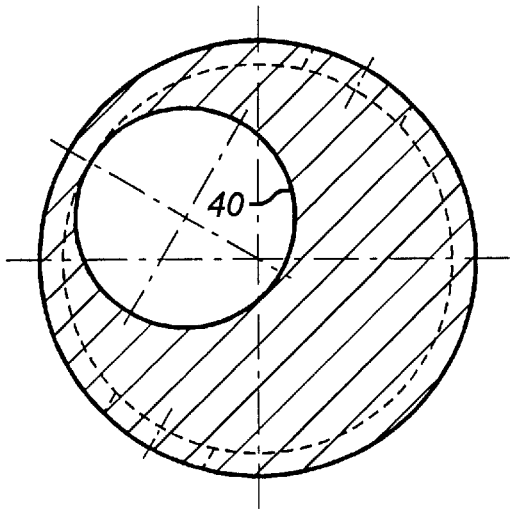
FIG. 5 is section view along lines 5—5 of FIG. 1*c*.
Figure 7:
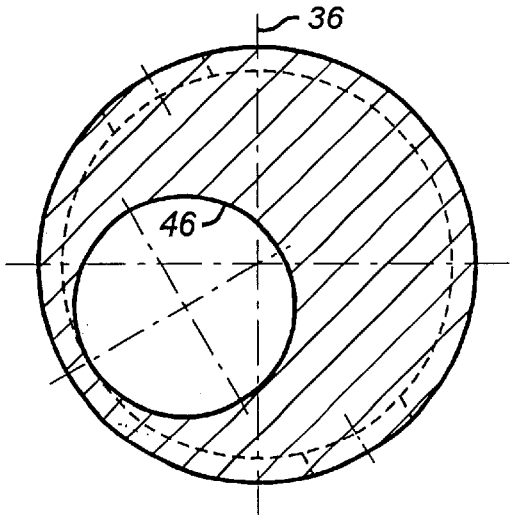
FIG. 7 is a section view along lines 7—7 of FIG. 1*d*.
Figure 8:
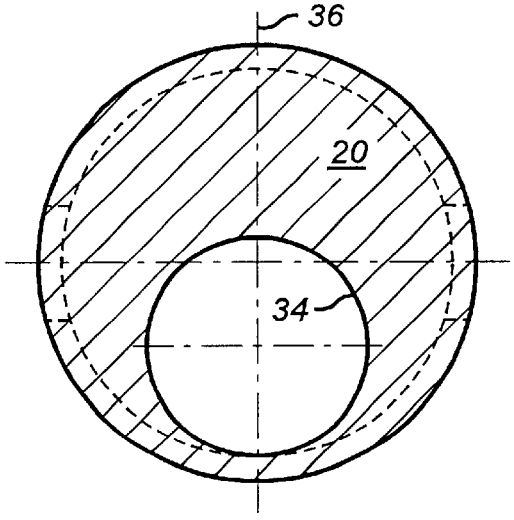
FIG. 8 is a section view along lines 8—8 of FIG. 1*e*.

Referring to FIGS. 1*a*–3, a rigid housing 10 is secured to the liner or casing string to be cemented at ends 12 and 14. A lower support ring 16 is secured by thread 18 and supports the flow diverter elements 20–32. In the preferred embodiment, the flow diverter elements 20–32 are identical in several respects. Referring to FIG. 8, diverter element 20 has a bore 34 whose centerline coincides with axis 36. The next flow diverter element 22 has a bore 38 offset 60° from axis 36, as shown in FIG. 7. The pattern follows throughout from one section to the next so that bore 40 is offset 60° from bore 38. Bore 42 is offset a further 60°, putting in alignment with axis 36, and so forth with regard to bores 44, 46, and 48. As shown in FIGS. 2 and 8, bores 48 and 34 are in alignment. While the increments shown have been in 60° rotation with respect to the axis 36, other incremental offsets between adjacent bores of adjacent elements, such as 20–32, can be used without departing from the spirit of the invention. The number of elements can also be varied. The elements 20–32, shown in FIGS. 1*a*–1*e*, are retained additionally by ring 50, which is attached to the housing 10 at thread 52. Rings 16 and 50 retain the elements 20–32 longitudinally so that they are not displaced during the cement circulating operation.

The elements 20–32 are rotationally locked to each other by a series of castellations at each end thereof. Thus, the lower ring 16 has a recess 54 into which fits tab 56 of element 20. The opposite end of element 20 has a recess 58 into which fits a tab 60 of element 22. This pattern is repeated throughout the diverter elements 20–32. The elements 20–32 drill out more easily because they are rotationally locked. They can also be made of softer metallics or composites such as aluminum or carbon fiber to expedite drillout. Each of the diverter elements 20–32 also has a groove such as 62 which contains preferably an O-ring seal 64. The purpose of the O-ring 64 which appear on each of the elements 20–32 is to prevent flow channels adjacent the interior wall 66 of housing 10.

Each of the elements 20–32, apart from having a bore therethrough, also has tapered transitions, such as 68 and 70, shown in FIG. 1*d,* respectively leading into and out of bore 38. These transitional inlets and outlets for each of the bores is repeated for each of the diverter elements 20–32. Thus, each of the diverter elements 20–32 has an internal venturi-like shape to maximize the mixing between the cement, or any other hardenable material such as blast furnace slag, for example, and the remaining drilling mud to ensure efficient displacement of the drilling mud, thus eliminating the roping effect.

The housing 10 is used in conjunction with a float collar, float shoe, and landing collar to conduct the cementing job on the liner in a deviated wellbore in a known manner. Due to the thorough mixing, the roping effect is minimized, if not eliminated. The peripheral seals also close off a path along the inside wall of the liner which could exist due to cement shrinkage.

The foregoing disclosure and description of the invention are illustrative and explanatory thereof, and various changes in the size, shape and materials, as well as in the details of the illustrated construction, may be made without departing from the spirit of the invention.

What is claimed:

1. A component for sealing a shoe track of a casing or liner string with a sealing material to address leakage situations which can occur after placement of the sealing material, comprising:

a tubular housing connectable to the string and having an inside wall;

a plurality of restrictions stacked in said housing to create turbulence therein to aid in displacement of well fluids by the sealing material.

2. The component of claim 1, further comprising:

peripheral seals mounted to at least one said restrictions for contact with said inside wall.

3. The component of claim 2, further comprising:

a locking member to prevent movement of said restrictions with respect to a longitudinal axis of said housing.

4. The component of claim 3, further comprising:

a detent on said locking member to retain at least one of said restrictions against rotation about the longitudinal axis of said housing.

5. The component of claim 4, further comprising:

a detent on each of said restrictions which engages an adjacent restriction so as to keep a stack of restrictions, each of which are touching an adjacent restriction all rotationally locked and longitudinally restrained.

6. The component of claim 5, wherein:

said locking member comprises an upper and a lower collar mounted to said housing, each collar having a detent to engage an adjacent restriction and said collars together keeping said restrictions locked rotationally and fixed longitudinally in said housing.

7. The component of claim 6, wherein:

said restrictions further comprise an annularly shaped component having a bore therethrough;

each said component having a bore offset from the bore of an adjacent component.

8. The component of claim 7, wherein:

each component comprises at least one taper adjacent said bore therethrough.

9. The component of claim 8, further comprising:

a pair of tapers, one on each end of said bore in each of said components.

10. The component of claim 9, wherein:

each said bore is disposed in each component at a fixed distance from the center of said housing;

said housing contains sufficient components so that at a predetermined angular offset about the center of said housing between each pair of components, the components closest to said upper and lower collars have their bores aligned.

11. The component of claim 2, further comprising:

longitudinally locking said components.

12. The component of claim 1, wherein:

said restrictions further comprise an annularly shaped component having a bore therethrough;

each said component having a bore offset from the bore of the next component.

13. The component of claim 12, wherein:

each component comprises at least one taper adjacent said bore therethrough.

14. The component of claim 13, further comprising:

a pair of tapers, one on each end of said bore in each of said components.

15. The component of claim 12, further comprising:

peripheral seals between said components and said inside wall.

16. The component of claim 15, further comprising:

a locking member to prevent movement of said components with respect to a longitudinal axis of said housing.

17. The component of claim 16, further comprising:

a detent on said locking member to retain at least one of said components against rotation about the longitudinal axis of said housing.

18. A method of cementing a shoe track of a liner using a string which comprises at least one component which constricts the opening thereon, comprising;

installing a housing in said liner adjacent said constriction in said liner;

creating turbulence in said housing when cement is pumped through it;

displacing mud from said liner due to said turbulence generated in said housing.

19. The method of claim 18, further comprising:

using a plurality of components with offset bores to create said turbulence.

20. The method of claim 19, further comprising:

sealing around at least one component and against an inside wall of said housing;

preventing leakpaths due to cement shrinkage by said sealing.

21. The method of claim 20, further comprising:

rotationally locking said components.

22. The method of claim 21, further comprising:

drilling out said components after said cement is pumped and has setup.

23. The method of claim 19, further comprising:

providing at least one taper in each component adjacent said bore.

24. The method of claim 18, further comprising:

disposing said liner with said housing at a deviation of at least 70° from vertical.

* * * * *